United States Patent [19]

Burda

[11] Patent Number: 5,062,576

[45] Date of Patent: Nov. 5, 1991

[54] ROTARY SHEAR-TYPE SHREDDER CUTTER WITH RECTANGULAR FEED TOOTH

[76] Inventor: Dan S. Burda, 7247 Lake Bluff Ct., Wilsonville, Oreg. 97070

[21] Appl. No.: 537,050

[22] Filed: Jun. 11, 1990

[51] Int. Cl.[5] ..... B02C 18/16

[52] U.S. Cl. ..... 241/167; 241/236; 241/295

[58] Field of Search ..... 83/500–503; 241/166, 167, 236, 235, 242, 243, 293, 295, 36

[56] References Cited

U.S. PATENT DOCUMENTS

| | | | |
|---|---|---|---|
| 3,146,960 | 9/1964 | DeGraff . | |
| 3,630,460 | 12/1971 | Goldhammer . | |
| 3,664,592 | 9/1969 | Schweigert et al. . | |
| 3,845,907 | 11/1974 | Schwarz . | |
| 3,868,062 | 2/1975 | Cunningham et al. . | |
| 4,034,918 | 7/1977 | Culbertson et al. . | |
| 4,253,713 | 3/1981 | Chambers, Sr. . | |
| 4,482,194 | 11/1984 | Chambers, Sr. . | |
| 4,560,110 | 12/1985 | Burda . | |
| 4,565,330 | 1/1986 | Katoh | 241/236 |
| 4,609,155 | 9/1986 | Garnier . | |
| 4,702,422 | 10/1987 | Chambers, Sr. et al. . | |
| 4,707,150 | 11/1987 | Graham . | |
| 4,793,561 | 12/1988 | Burda . | |
| 4,833,866 | 5/1989 | Newton et al. . | |

FOREIGN PATENT DOCUMENTS

| | | | |
|---|---|---|---|
| 2614998 | 10/1977 | Fed. Rep. of Germany | 241/236 |
| 3430087 | 2/1986 | Fed. Rep. of Germany | 241/236 |
| 2118065 | 10/1983 | United Kingdom | 241/236 |

OTHER PUBLICATIONS

DWS Disposable Waste Systems, Inc., Santa Ana, California, Product Brochure, 1988.

*Primary Examiner*—Mark Rosenbaum

*Attorney, Agent, or Firm*—Marger, Johnson, McCollom & Stolowitz, Inc.

[57] ABSTRACT

A rotary shear type shredder for shredding a wide range of materials, including flat and sheet materials has a plurality of spaced, intermeshed coacting cutter discs mounted for counterrotation on a parallel shaft. Each disc has a single cutter hook and a single rectangular cutter block fixedly mounted on opposite circumferential sides thereof. The hooks and blocks are arranged to form a spiral of cutters and hooks mounted on each shaft a 180 degrees apart and positioned so that blocks on one shaft feed material to hooks on the other shaft. The cutter blocks have a pair of right-angle cutter edges on both front and back sides for coacting with discs and hooks when rotated in a forward direction and coacting with cleaning fingers when reversed.

11 Claims, 1 Drawing Sheet

ROTARY SHEAR-TYPE SHREDDER CUTTER WITH RECTANGULAR FEED TOOTH

BACKGROUND OF THE INVENTION

This invention relates generally to rotary shear-type shredders, and more particularly to the configuration and arrangement of cutter discs therefor.

Rotary shear-type shredding devices of the type disclosed incorporate first and second parallel horizontal side-by-side counterrotating shafts mounted in a housing. Circular disc-type cutters are stacked on each shaft with circular spacers interposed between each such cutter disc; each cutter disc typically having one hook attached thereto. Usually the hooks curve or slant toward the direction of rotation of the disc and have a backside tangential to the circumference of the cutter. One typical example of the above is U.S. Pat. No. 4,034,918 disclosing a shredding apparatus driven by a hydraulic motor. Each cutter disc employs one slanted, curved hook to grab and pull gravity fed material into and through the cutters.

One problem with this arrangement, however, is that flat or sheet materials are difficult for the hooks to grab. These difficult-to-grab materials include pallets, plywood, press board, cardboard, etc., as well as rubber tires, sheet metal, and scrap. Accordingly, this type of shredder requires additional means to force such materials through the cutters. As such, some manufacturers include a ram-type assist mechanism that pushes difficult-to-grab materials downward into the cutting chamber. Moreover, manufacturers frequently recommend larger feed openings as an additional measure to further alleviate this problem.

Another problem arises with this arrangement because these machines are designed to reverse briefly in case a jamming condition occurs. Ideally, reversal will rearrange the material being shredded so that it can be shredded more easily when the shredder returns to normal operation. Slanted hooks, however, are only marginally effective in rearranging materials upon reversal. The slanted or tangential rear sides of the hooks slide under the material without grabbing it. Other rotary shear-type shredders are discussed in U.S. Pat. Nos. 4,833,866; 4,793,561; 4,702,422; 4,609,155; 4,560,110; 4,034,918; 3,868,062; 3,845,907; 3,664,592; 3,630,460; 3,146,960.

Another apparatus used to break down the solids found in sewage and sludge is a grinder manufactured by Disposable Waste Systems, Inc. Like a rotary shear-type shredder, this apparatus employs parallel grinder shafts with stacked cutter discs on each shaft. A plurality of block-shaped cutter elements are attached to each cutter disc. Each cutter element has a parallelogram shaped cross-section with two opposite leading edges that can cut in each direction. With this arrangement, however, the primary function of the blocks is to cut and grind, not to grab and pull. Thus, although this arrangement is effective for grinding solids found in sewage, and certain dry solids, it is limited to those applications where difficult-to-grab materials are not processed. Lacking any hook-type teeth and having many cutter elements on each disc, this machine is likely to be ineffective in shredding sheet metal or other flat materials.

Accordingly, there is a need for a configuration and arrangement of cutter discs that improve the efficiency of rotary-type shredders to process difficult-to-grab materials.

SUMMARY OF THE INVENTION

One object of the invention is to improve material feed characteristics of rotary shear-type shredders.

Another object of the invention is to efficiently shred difficult-to-grab flat materials.

Yet another object is to decrease the down time of the equipment caused by materials that do not feed properly.

Still another object is to require less labor to operate rotary shear-type shredders.

One advantage of the invention is a more balanced weight distribution on the cutter disc wherein stresses created by rotation are reduced.

Another advantage is that less equipment is required to process difficult-to-grab materials, i.e., no ram mechanism is required to assist in feeding such material through the cutters, and oversize feed openings are unnecessary.

To solve the problems of processing difficult-to-grab materials while retaining the capability of shredding sheet metal, the invention employs a combination of a curved, slanted hook and a rectangular block mounted on the outer peripheral surface of each cutter disc. Each cutter disc is mounted on its respective shaft and aligned so that each hook on a cutter disc coacts with a block mounted on an opposing cutter disc on the parallel shaft. In other words, each cutter disc has an equal number of hooks and blocks: each block coacting with a hook of the opposing cutter disc, and each hook coacting with a block of the opposing cutter disc.

The present invention comprises a rotary shear-type shredder including two parallel horizontal shafts with a plurality of coacting cutter discs mounted thereon. The shafts are located in a housing and are driven in opposite directions, i.e., the shafts are counterrotated by a motor. Each of the cutter discs are separated by spacer discs of smaller diameter; this allows the cutters on opposing shafts to overlap or mesh. Preferably, each cutter disc has only one hook and only one rectangular block, mounted on opposite sides of the cutter disc. The cutter discs preferably are arranged on the shafts so that angular position of the blocks and the hooks on successive cutter discs incrementally change thereby spiraling about each shaft. This arrangement enables flat or sheet materials to be grabbed by the rectangular blocks during either forward or reverse rotation.

The foregoing and other objects, features and advantages of the present invention will become more apparent from the following detailed description, which proceeds with reference to the accompanying drawings.

DETAILED DESCRIPTION OF PREFERRED EMBODIMENT

Figure 1:
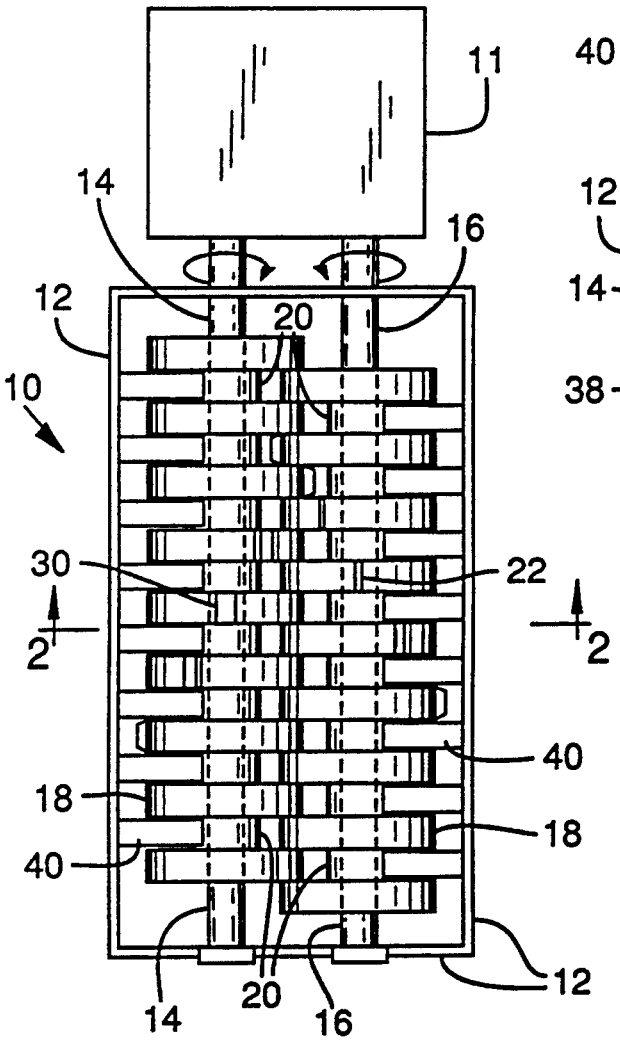
FIG. 1 is a plan view of a rotary shear-type shredder including shredder housing, cutter shafts, drive unit and cutter discs in accordance with the invention.
Figure 2:
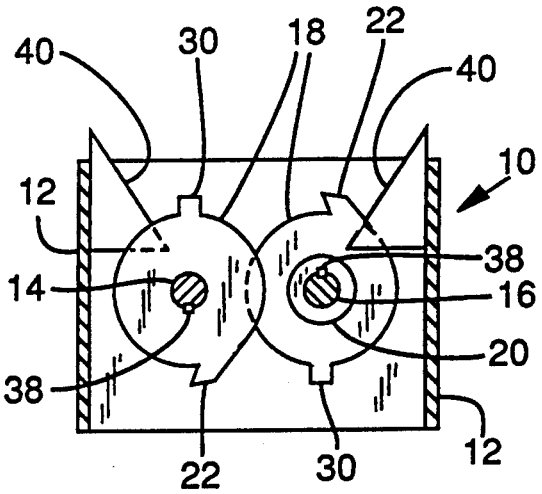
FIG. 2 is a cross-sectional view taken along line 2—2 of FIG. 1.

With reference first to FIGS. 1 and 2 of the drawings, a shredder 10 constructed in accordance with the present invention is generally depicted. Generally speaking, shredder 10 comprises an automatically reversible drive 11, which is conventional, and a housing 11 adapted to accommodate the various components of a shear-type rotary shredder.

The shredder housing 12 has an inlet at the top and a discharge at the bottom thereof. Essentially, the shredding components in the housing 12 comprise a first horizontal cutter shaft 14 journaled at opposite ends for rotation within said housing 12, and a second, parallel horizontal cutter shaft 16 journaled at opposite ends for rotation within said housing 12. Each shaft mounts a series of substantially identical annular cutter discs 18 at equally spaced-apart positions along the shafts. The equal spacing is maintained by a circular spacer disc 20 interposed between each cutter disc 18. For reasons more fully explained below, the spacer discs 20, ideally, are approximately 0.014 of an inch larger in width than the cutter discs, and have an outside diameter approximately one half that of the cutter discs.

The cutter discs on the first shaft 14 are positioned to line up with the spacers 20 on the second shaft 16. Likewise, the cutter discs on the second shaft 16 are positioned to line up with the spacers 20 on the first shaft. The above arrangement allows the cutter discs 18 of either shaft to mesh with opposing cutter discs on the opposite shaft. Because the spacer discs 20 are slightly wider than the cutter discs, the cutter discs on both shafts mesh with enough clearance to properly shred and cut materials. Also, the meshing of opposing cutter discs requires that the spacers 20 have a smaller outside diameter than the cutter discs 18: approximately one half the cutter disc diameter as previously stated. Similarly, the smaller outside diameter of the spacers 20 provides space to accommodate the extension of cleaning fingers 40 from the elongated sides of the housing to a position between the cutter discs, just short of the spacers 20. These fingers 40 are inclined inward and downward to help prevent materials from passing around the cutter discs on the wrong side, i.e., the fingers direct material to the proper location between opposing cutter discs 18.

Figure 3:
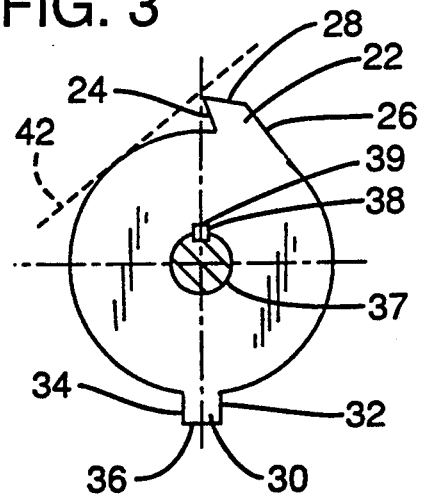
FIG. 3 is an enlarged elevational view of a single cutter disc in accordance with the invention.

Attention is directed to FIG. 3 for a more detailed description of the structure of the cutter disc 18. Cutter discs 18 preferably comprise one hook 22 and one block 30 that extend outward from the circumferential surface of the disc, although a cutter disc can operate with several hooks and blocks. The hook shaped projection 22 is substantially the same width as the cutter disc 18, and has three sides: a radial front side 24, a tangential back side 26, and a top side 28. The radial side 24 extends in an approximately radial direction away from the circumference of cutter disc 18 approximately a distance of $\frac{1}{8}$ to $\frac{1}{4}$ of the diameter of the cutter disc. To improve the grabbing characteristics of the hook, the radial side 24 may slant slightly from the cutter disc 18 toward the direction of rotation. A flat top side 28 is optionally used but is not necessary for the operation of the hook. When included, the top side 28 connects the tangential back side 26 to the radial front side 24. Generally, the top side lies in a plane approximately normal to the plane of the radial side, and is nearly the same length as the radial side 24. Finally, the tangential side 26 is defined by a line beginning at the circumference of cutter disc 18, extending therefrom tangentially to a point defined by the end of top side furthest from the radial side.

The block 30 is located angularly 180 degrees from the curved or slanted hook. The hook and block thus lie wholly below a tangent line 42 at a point on the circumferential surface of the cutter disc so that sheet material can contact the cutter disc therebetween. In contrast to the curved hook depicted above, block 30 is rectangular in shape with two parallel front and rear sides 32, 34, perpendicular to the axial end faces of the disc, and one top side 36 extending normal to and connecting the two parallel sides. The block thus has two opposite right-angle edges on both front and rear sides 32, 34. The block is symmetrical about a line extending radially from the center of the disc, i.e., the two parallel sides of the block 32, 34 are parallel to such a line extending radially from the center of the disc through the center of the block. Similar to the curved hook, the block is substantially the same width as the cutter disc, and extends outward from the disc in a radial direction substantially as far as the curved hook, i.e., $\frac{1}{8}$ to $\frac{1}{4}$ of a cutter disc diameter.

Each cutter disc and each spacer is fixedly mounted to one of the parallel shafts by a key 38 disposed between the cutter disc or spacer, and the shaft. To accommodate the key, a groove 39 or keyway is formed on the radial inner surface of an axial bore 37 that extends through each cutter disc and through each spacer. Similarly, a keyway is formed on the radially outer surface of each shaft 14, 16 to receive the key 38 when the spacers and cutter discs are placed on the shafts. Relative to the shaft, the angular position of the hook, and likewise of the block, is determined by the keyway location on the radial inner surface of the coaxial bore extending through the cutter disc as described above.

For optimal efficiency in processing difficult-to-grab materials, the preferred arrangement of the cutter discs 18 on the two parallel cutter shafts 14, 16 positions the blocks and the hooks so that a block on one cutter disc will coact with a hook on the opposing cutter disc of the parallel shaft. Moreover, to further increase efficiency, the hooks and opposing blocks are positioned so that they do not all coact at the same time, i.e., the hooks and the blocks spiral around each shaft. By doing this, the power required to drive the shafts is distributed more evenly and continuously as the shafts rotate thus reducing high instantaneous power demands that would result if all hooks and blocks coacted simultaneously. To achieve this, the preferred embodiment calls for each cutter disc on each shaft to be successively rotated 22 $\frac{1}{2}$ degrees in relation to a directly adjacent cutter disc on the same shaft. Thus, the angular position of the hook and the block changes incrementally in relation to the same on successive cutter discs located on the same shaft. As previously stated, this is accomplished by selectively positioning the keyway on the radially inner surface of each cutter disc.

OPERATION

To operate the above-described apparatus, the shafts are driven with a drive means 11 that rotates each shaft in opposite directions. The shafts are driven in opposite directions so that the upper portions of the cutters on the two shafts rotate toward each other. Materials are fed into the shredder from above and forced downward, between the two shafts, through the apparatus.

As each hook 22 moves inward, an opposing block 30 does likewise, to grab and feed material toward one another and shear the material between them. The hook and block on each disc 18 are spaced angularly apart a sufficient distance for flat or sheet material to fall between them, into contact with the circumferential surface, so that the material is reliably grabbed. During reversal, the back sides of the blocks 30 can grab material to rearrange it and to shear it against the cleaning fingers 40.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

1. A rotary shear-type shredder comprising:

a housing having an inlet at the top and a discharge at the bottom thereof;

first and second parallel spaced cutter shafts mounted for rotation within said housing;

reversible drive means for counterrotating said cutter shafts;

a plurality of cutter discs and spacers fixedly stacked on each of said first and second cutter shafts, a spacer disposed between each said cutter disc so that opposing cutter discs can mesh in coacting relationship for shearing of material;

a hook fixedly mounted on the circumferential surface of said cutter disc, slanted toward the direction of rotation for grabbing and pulling material through said cutter discs; and a rectangular block fixedly mounted on the circumferential surface of each said cutter disc at a position spaced angularly from said hook, said rectangular block having parallel front and back sides, each side forming a pair of opposite right-angle cutting edges to improve grabbing and shredding of difficult-to-grab flat material.

2. A rotary shear-type shredding apparatus according to claim 1 wherein each said block is angularly positioned so as to be opposed by a coacting hook on an opposing cutter disc on the parallel shaft.

3. A rotary shear-type shredding apparatus according to claim 2 wherein an equal number of blocks and hooks are mounted on each said cutter disc, each block on each said cutter disc angularly spaced about 180 degrees apart from a hook on the circumferential surface of said cutter disc.

4. A rotary shear-type shredding apparatus according to claim 3 wherein the blocks and hooks alternate angularly along the circumferential surface of each said cutter disc to improve grabbing and shredding of difficult-to-grab flat material.

5. A rotary shear-type shredding apparatus according to claim 4 wherein the angular spacing between each block and hook on each said cutter disc is equal.

6. A rotary shear-type shredding apparatus according to claim 5 wherein the angular position of each hook and each block on the circumferential surface of each cutter disc changes incrementally in relation to the shaft, the increments being equal, thereby causing the hooks and the blocks from one cutter disc to the next to spiral about the shaft.

7. A rotary shear-type shredding apparatus according to claim 6 wherein the incremental change in relative angular position of the hooks and blocks relative to the shaft is 22-½ degrees.

8. A rotary shear-type shredding apparatus according to claim 1 wherein the angular spacing between each circumferentially adjacent block and hook on each cutter disc is large enough so that each adjacent block and hook falls below a line tangent to the circumferential surface of said cutter disc so that flat material of any width can lay against the cutter disc without contact with a block or adjacent hook.

9. A rotary shear-type shredding apparatus according to claim 1 in which the housing includes a plurality of cleaning fingers positioned between the cutter discs for coacting with the blocks during a reversal of rotation of the shafts.

10. A rotary shear-type shredding apparatus comprising:

a housing having an inlet at the top and a discharge at the bottom thereof;

first and second parallel spaced cutter shafts mounted for rotation within said housing;

reversible drive means for counterrotating said cutter shafts;

a plurality of cutter discs and spacers fixedly stacked on each of said first and second cutter shafts, a spacer disposed between each said cutter disc so that opposing cutter discs can mesh in coacting relationship for shearing of material;

a hook fixedly mounted on the circumferential surface of said cutter disc, slanted toward the direction of rotation for grabbing and pulling material through said cutter discs; and a rectangular block fixedly mounted on the circumferential surface of each said cutter disc to improve grabbing and shredding of difficult-to-grab flat material, wherein a single block and a single hook are mounted on each said cutter disc, the block and hook on each cutter disc being angularly spaced about 180 degrees apart on the circumferential surface of said cutter disc.

11. A rotary shear-type shredding apparatus according to claim 10 in which each block has parallel front and back sides, each side forming a pair of opposite right-angle cutting edges.

* * * * *